US006093262A

United States Patent [19]

Bouldin

[11] Patent Number: 6,093,262

[45] Date of Patent: Jul. 25, 2000

[54] CORROSION RESISTANT SOLENOID VALVE

[75] Inventor: Brett Bouldin, Spring, Tex.

[73] Assignee: PES, Inc., The Woodlands, Tex.

[21] Appl. No.: 09/103,673

[22] Filed: Jun. 23, 1998

[51] Int. Cl.[7] ..... H01F 1/14

[52] U.S. Cl. ..... 148/313; 148/312; 420/435; 420/441; 420/460; 251/129.09; 251/129.15

[58] Field of Search ..... 148/312, 313; 420/435, 441, 460; 251/129.09, 129.15

[56] References Cited

U.S. PATENT DOCUMENTS

| | | | |
|---|---|---|---|
| 3,715,206 | 2/1973 | Komatsu et al. . | |
| 3,761,904 | 9/1973 | Chin et al. | 340/174 ZB |
| 4,018,569 | 4/1977 | Chang | 428/678 |
| 4,325,733 | 4/1982 | Aboaf et al. . | |
| 4,440,720 | 4/1984 | Masumoto et al. | 420/459 |
| 4,676,829 | 6/1987 | Chang et al. | 75/246 |
| 4,891,183 | 1/1990 | Corwin | 420/435 |
| 5,628,814 | 5/1997 | Reeves et al. | 75/255 |
| 5,631,094 | 5/1997 | Ranjan et al. | 428/611 |

OTHER PUBLICATIONS

Hansen (I), Constitution of Bianry Alloys, pp. 511–514, 1958.

Hansen (II), Constitution of Binary Alloys, pp. 10491053, 1958.

Weidner et al., Elementary Classical Physics, Apr. 1967, pp. 837 to 838.

The American Heritage Dictionary of the English Language, p. 1229, 1976.

*Primary Examiner*—John Sheehan
*Attorney, Agent, or Firm*—Alan J. Atkinson

[57] ABSTRACT

A ferromagnetic, high strength, corrosion resistant material for use in electromagnetic equipment. The material comprises Cobalt or Nickel or a combination of these elements in an amount equal to or greater than 60% by weight, with the balance comprising one of a group consisting of Beryllium, Lithium, Aluminum, or Titanium. In different embodiments of the invention, 3% or less of the material comprises Beryllium, with the balance comprising Nickel or Cobalt. The material provides adequate yield strength for use downhole in wellbores, is highly resistant to corrosion induced by downhole well fluids and sea water, and has high ferromagnetic characteristics suitable for use in solenoid valves and other downhole well equipment.

11 Claims, 1 Drawing Sheet

CORROSION RESISTANT SOLENOID VALVE

BACKGROUND OF THE INVENTION

The present invention relates to the field of solenoid valves for controlling tool operation downhole in a hydrocarbon producing well and in subsea well installations. More particularly, the invention relates to a downhole solenoid valve constructed with a material having appropriate ferromagnetic and strength properties, and having high corrosion resistance to downhole well fluids and salt water.

Downhole solenoid actuated tools control the production of pressurized oil and gas in hydrocarbon producing wells and in subsea well applications. Solenoids control different operations including the opening and closing of valves, sliding sleeves, packers, wellheads, and other downhole well tools and subsea well systems. Solenoids and other tool actuators are typically constructed with ferromagnetic materials containing Iron (Fe) and Iron alloys. When a electric coil is actuated around the alloy, the Iron acts as a magnet for actuating the solenoid.

Although Iron alloys and stainless steel alloys conventionally provide the material for solenoid valves, such alloys are still corrosive and do not withstand exposure to downhole well fluids and salt water found in subsea installations. Many efforts have been made to improve solenoid valve corrosion resistance while retaining the ferromagnetic properties of the valve. In a pure form, Iron is relatively weak and requires alloy additions to increase strength and corrosion resistance. Iron is typically alloyed with carbon (C) and with Silicon (Si) to increase strength. Neither of these elements increase corrosion resistance, accordingly small amounts of Chromium (Cr), Molybdenum (Mo), and Manganese (Mn) are added to Iron alloys to increase the corrosion resistance without significantly reducing the ferromagnetic properties of the solenoid valve material. For example, U.S. Pat. No. 4,770,723 to Sagawa et al. (1988) disclosed a substantially Iron magnet including rare Earth elements and intermetallic compounds where at least 50% of the entire material had a Fe-B-R type tetragonal structure, Another technique for reducing corrosion was shown in U.S. Pat. No. 5,529,747 to Learman (1996), where up to 35% of an epoxy binder was mixed with a ferromagnetic material such as Iron powder to isolate the Iron particles from corrosion. Other sintered magnets using Cobalt (Co) in a permanent magnet were disclosed in U.S. Pat. No. 3,892,598 to Martin (1975) and in U.S. Pat. No. 4,533,407 to Das et al. (1985).

Various alloys have been developed to improve magnet performance. U.S. Pat. No. 4,404,028 to Panchanathan et al. (1983) disclosed a nickel rich alloy having Copper and small amounts of Boron to produce improved mechanical properties and good corrosion and oxidation resistance. Other alloys have been developed to provide strength to materials which also provide ferromagnetic properties, such as in U.S. Pat. No. 4,297,135 to Giessen et al. (1981) which disclosed a high strength Iron, Nickel and Cobalt base crystalline alloy having dispersion of borides and carbides. The alloy contained Iron, Nickel or Cobalt in a range between 85–95% by atomic percentages, at least 3% Boron, and the balance from a select metal group. U.S. Pat. No. 4,133,680 to Babaskin et al. (1979) disclosed dopant materials in weight amounts ranging between 3 to 25 by volume percent for combination with a base of Iron and Nickel.

Other alloys have been developed to increase wear characteristics while maintaining superb magnetic properties for magnetic recording and reproduction. In U.S. Pat. Nos. 5,725,687 (1998) and 5,496,419 (1996) to Murakami et al., wear resistant, high permeability alloys having Nickel and Iron in combination with other elements including less than 3% of Beryllium (Be), Silver (Ag), Strontium (Sr), and Barium (Ba). However, these alloys were developed for the recording industry where wear characteristics are important and yield strength is relatively unimportant.

In addition to corrosion considerations, the narrow confines of downhole wellbores limit the space available for solenoid valves and other solenoid actuated equipment. Larger solenoid valves cannot easily be placed transversely in the wellbore, and larger solenoid valves occupy space interfering with the production of hydrocarbon fluids. In deep wells, high fluid pressures require a solenoid having sufficient ferromagnetic properties to actuate downhole equipment. There are no known materials or compounds which combine the requisite corrosion resistance, mechanical strength, and ferromagnetic properties to adequately provide a small solenoid valve capable of operating downhole in a wellbore.

Various alloys have been developed to provide corrosion resistant solenoid valves. Necessary properties for the alloys comprise a high saturation induction to develop a strong magnetic field for reducing the actuation energy required, high permeability for permitting the development of small, efficient components, a low coercive field strength permitting rapid magnetization and demagnetization for fast valve operation, freedom from magnetic aging so that the magnetic properties are sustained over time, electrical resistivity for efficient operation of solenoid valves, and corrosion resistance for withstanding downhole corrosive fluids.

Silicon is added to low Carbon Iron to increase hardness and electrical resistivity, however such alloys have minimal resistance to corrosive environments and are often plated to build corrosion resistivity. Chromium-Iron alloys provide good corrosion resistance and adequate magnetic properties for core applications, however such alloys allow higher core losses and provide lower saturation and permeability than Silicon-Iron alloys. An example of a Chromium-Iron alloy is Type 430F solenoid quality stainless steel, having 18% Chromium content and small quantities of Molybdenum, which has superior magnetic properties and low residual magnetism when compared to other stainless steels.

Other solenoid alloys known as Chrome-core alloys are controlled-chemistry, ferritic, Chromium-Iron alloys having superior corrosion resistance to pure Iron, low-Carbon steel, or Silicon-Iron alloys, yet having greater immunity to the saturation induction decline associated with 18% Chromium ferritic stainless steels. Various of the Chrome-core alloys have 8% and 12% Chromium, and have flux densities approaching Electrical Iron and Silicon Core Iron at magnetic field strengths exceeding 800 A/M. 13% Chromium alloys further raise the electrical resistivity while providing good corrosion resistance and stable ferrite, and Molybdenum and Niobium have been added to 18% Chromium-core alloys to increase corrosion resistant properties while providing relatively high electrical resistivity.

One commercially available solenoid alloy marketed as Hiperco 50A Alloy by the Carpenter Technology Corporation of Reading, Penn. incorporates 0.01% Carbon, 0.05% Manganese, 0.05% Silicon, 48.75% Cobalt, 1.90% Vanadium, and the balance Iron. This material is used primarily as the magnetic core material in electrical equipment requiring high permeability at very high magnetic flux densities, and has electrical resistivity of 253 ohms c/mf and 420 microhm-mm. The relatively high Iron content of this alloy limits the use of this solenoid alloy in high corrosion applications.

There is, accordingly, a need for an improved material for providing strength, corrosion resistance, and magnetic performance for use in downhole well applications and in subsea well systems.

SUMMARY OF THE INVENTION

The present invention discloses a ferromagnetic, corrosion resistant material for use in electromagnetic equipment. The material comprises either Cobalt or Nickel in an amount equal to or greater than 60% by weight, with the balance comprising one of a group consisting of Beryllium, Lithium, Aluminum, or Titanium. In different embodiments of the invention, the balance of the material is provided by at least two of the group consisting of Beryllium, Lithium, Aluminum, and Titanium, and the electromagnetic equipment can comprise a solenoid such as is used with a downhole solenoid valve. The material can have a yield strength of at least 60 ksi, and the material can comprise Beryllium in an amount by weight equal to or less than 3% with the balance formed with Cobalt, Nickel, or a combination of Cobalt and Nickel.

DESCRIPTION OF THE PREFERRED EMBODIMENTS

Figure 1:
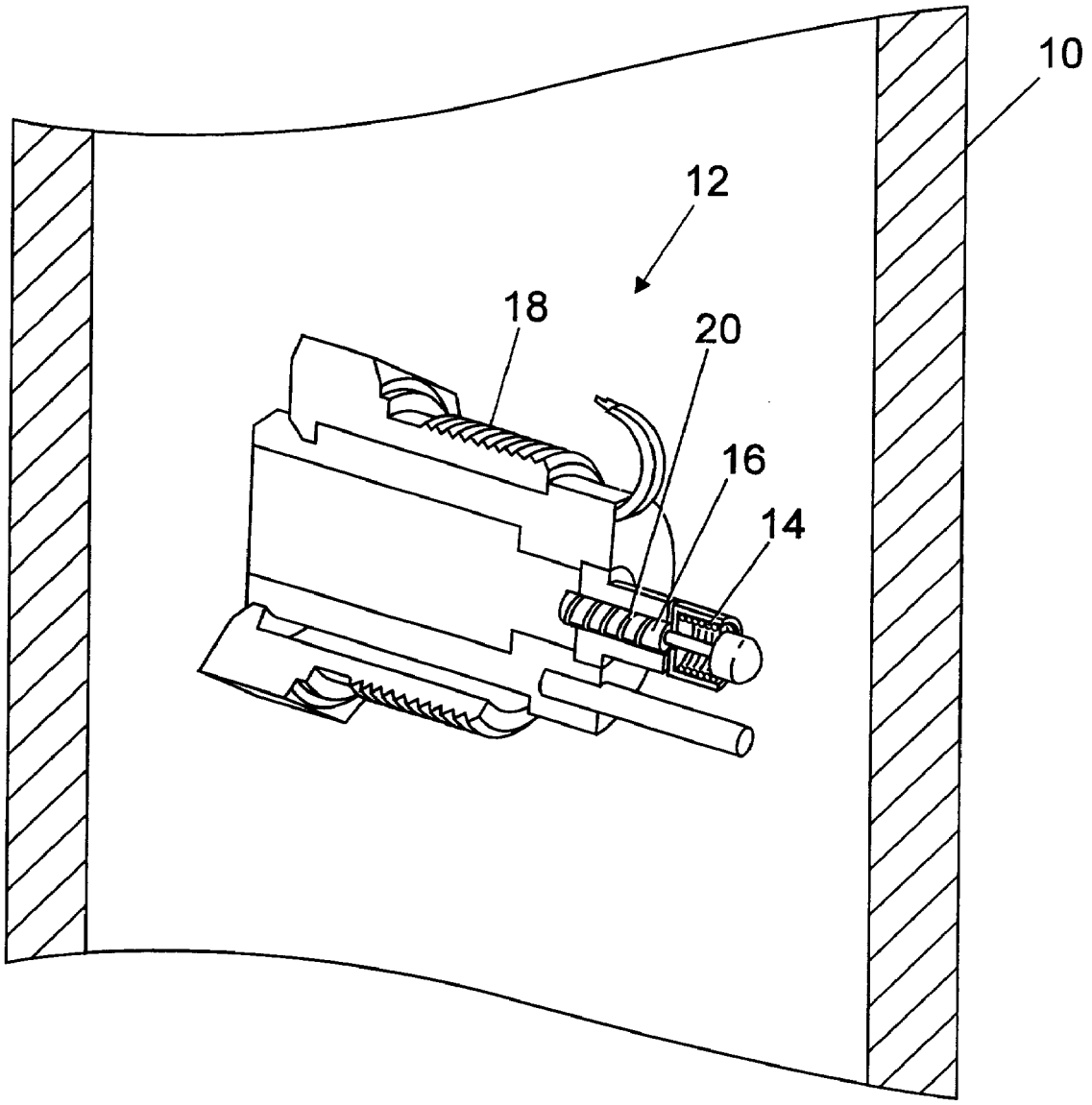
FIG. 1 illustrates a solenoid valve having a ferromagnetic core material substantially formed with Cobalt or Nickel.

FIG. 1 illustrates one application of the invention to equipment suitable for use downhole in wellbore 10. Solenoid valve 12 is actuated by electricity passing through coil 14 to activate ferromagnetic core 16. Following such activation, core 16 moves relative to coil 14 to perform a function relative to equipment such as downhole well tool 18. After the electricity through coil 14 is removed, spring 20 returns core to the initial position.

Core 16 should be sufficiently small to fit within wellbore 10 in transverse and other orientations relative to a longitudinal axis passing through wellbore 10. Core 16 should also resist corrosion induced by hydrocarbon and other fluids located in wellbore 10, and should be sufficiently strong to operate tool 18. Preferably, the yield strength of material for core 16 should be at least 60 ksi. This discovery provides for consideration of potential solenoid alloys previously unknown in downhole well tool applications and in subsea well installations. Cobalt (Co) and Nickel (Ni) provide strong ferromagnetic properties, however the pure and annealed form of these elements are very weak and are not suitable for constructing solenoid valves. Elemental Nickel is very weak and has a yield strength between 15–25 ksi. Elemental Cobalt is weak and has a yield strength between 20–40 ksi. Accordingly, solenoid valves constructed from pure Cobalt or Nickel would require large structures sufficient to accommodate the force requirements of downhole solenoid valves, and these large structures would not fit within the confined spaces downhole in a wellbore.

If up to 3% Beryllium (Be) is added to Nickel, the atoms of Beryllium are small compared to the Nickel so that solution annealing and aging will precipitate the Beryllium out in the grain boundaries of the microstructure, greatly increasing the material strength. Although pure Nickel has 15–25 ksi yield strength, addition of 2% Beryllium plus solution annealing and aging results in a yield strength in the range 170–220 ksi, sufficiently exceeding the requirements for downhole solenoid valves. Other small elements such as Lithium (Li), Aluminum (Al), or Titanium (Ti) can be added to Nickel to accomplish the strength properties provided by Beryllium.

Elemental Cobalt has a yield strength in the range 20–40 ksi, however the corrosion resistance and ferromagnetic properties are excellent. The addition of up to 3% Beryllium or other small elements such as Lithium, Aluminum, or Titanium to Cobalt, followed by solution annealing and precipitation hardening or other form of aging, will result in an alloy having sufficient strength to form a solenoid core.

A material equal to 60% by weight or greater of Nickel or Cobalt will provide high corrosion resistance and suitable ferromagnetic qualities for use downhole in wellbore 10 or in subsea applications, provided that at least a portion of the material balance is formed with at least one of a group consisting of Beryllium, Lithium, Aluminum, or Titanium. In another embodiment of the invention, two or more of the elements in this group can form the material balance. In a preferred embodiment of the invention, 3% or less of the material can be formed with Beryllium, with the balance to be formed with either Nickel or Cobalt, or a combination of Nickel and Cobalt.

The invention uniquely provides a material having adequate ferromagnetic properties, strength, and corrosion resistance to operate downhole in wellbores with equipment such as well tools, and in subsea well applications. The material disclosed by the invention provides combined advantages not available with conventional solenoid magnet materials, and offers significant flexibility in the design of downhole well tool systems used in the production of hydrocarbons. In subsea well systems, the material is highly resistant to corrosion induced by salt water, and is suitable for providing the magnetic and strength properties necessary for high pressure performance in subsea actuators.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A downhole solenoid valve, comprising:

a housing;

a solenoid core moveable relative to said housing, wherein said solenoid core comprises cobalt in an amount equal to or greater than 60% by weight, and the balance comprising one of a group consisting of beryllium, lithium, aluminum, or titanium; and electrical means for actuating said solenoid core.

2. A valve as recited in claim 1, wherein the balance of said solenoid core comprises at least two of the group consisting of beryllium, lithium, aluminum, and titanium.

3. A valve as recited in claim 1, wherein said solenoid core has a yield strength of at least 60 ksi.

4. A valve as recited in claim 1, wherein said solenoid core comprises beryllium in an amount by weight equal to or less than 3%, with the balance of cobalt.

5. A downhole solenoid valve, comprising:

a housing;

a solenoid core moveable relative to said housing, wherein said solenoid core comprises nickel in an amount equal to or greater than 60% by weight, and the balance comprising one of a group consisting of beryllium, lithium, aluminum, or titanium; and electrical means for actuating said solenoid core.

6. A valve as recited in claim 5, wherein the balance of the solenoid core comprises at least two of the group consisting of beryllium, lithium, aluminum, and titanium.

7. A valve as recited in claim 5, wherein said solenoid core has a yield strength of at least 60 ksi.

8. A valve as recited in claim 5, wherein said solenoid core comprises beryllium in an amount by weight equal to or less than 3%, with the balance of nickel.

9. A downhole solenoid valve, comprising:

a housing;

a solenoid core moveable relative to said housing, wherein said solenoid core comprises cobalt in an amount equal to or greater than 10% by weight, nickel in an amount equal to or greater than 50% by weight, and the balance comprising one of a group consisting of beryllium, lithium, aluminum, or titanium; and electrical means for actuating said solenoid core.

10. A valve as recited in claim 9, wherein the balance of said solenoid core comprises at least two of the group consisting of beryllium, lithium, aluminum, and titanium.

11. A valve as recited in claim 9, wherein said cobalt and nickel combine to comprise at least 97% by weight of said solenoid core.

* * * * *

UNITED STATES PATENT AND TRADEMARK OFFICE
Certificate

Patent No. 6,093,262 Patented: July 25, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Brett Bouldin, Spring, Texas; Robert S. Taylor, Duncan, Oklahoma Signed and Sealed this Twenty-Fourth Day of April, 2001.

ROY V. KING
*Supervisory Patent Examiner*
Art Unit 1742